US011597413B2

(12) United States Patent
Bollengier

(10) Patent No.: US 11,597,413 B2
(45) Date of Patent: Mar. 7, 2023

(54) RAILWAY VEHICLE COMPRISING A PERFECTED SYSTEM OF PROTECTION AGAINST PRESSURE WAVES

(71) Applicant: SpeedInnov, Paris (FR)

(72) Inventor: Christophe Bollengier, Sentheim (FR)

(73) Assignee: SPEEDINNOV, Paris (FR)

( * ) Notice: Subject to any disclaimer, the term of this patent is extended or adjusted under 35 U.S.C. 154(b) by 589 days.

(21) Appl. No.: 16/684,983

(22) Filed: Nov. 15, 2019

(65) Prior Publication Data

US 2020/0156669 A1 May 21, 2020

(30) Foreign Application Priority Data

Nov. 21, 2018 (EP) ..... 18306540

(51) Int. Cl.

| | |
|---|---|
| ***B61D 27/00*** | (2006.01) |
| ***B61D 19/02*** | (2006.01) |
| ***B61L 25/02*** | (2006.01) |
| ***B61L 27/04*** | (2006.01) |

(52) U.S. Cl.

CPC ..... *B61D 27/0009* (2013.01); *B61D 19/02* (2013.01); *B61L 25/025* (2013.01); *B61L 25/026* (2013.01); *B61L 27/04* (2013.01); *B61L 2201/00* (2013.01)

(58) Field of Classification Search

CPC ... B61D 27/0009; B61D 19/02; B61L 25/025; B61L 25/026; B61L 2205/04; B60L 2201/00

See application file for complete search history.

(56) References Cited

U.S. PATENT DOCUMENTS

| | | | | |
|---|---|---|---|---|
| 6,108,602 A | 8/2000 | Bairamis | | |
| 2020/0189620 A1 * | 6/2020 | Bahman | ..... | B61D 19/02 |

FOREIGN PATENT DOCUMENTS

| | | | | |
|---|---|---|---|---|
| CN | 105 216 830 | | 1/2016 | |
| CN | 108839662 A | * | 11/2018 | ..... B61C 17/00 |
| CN | 109552350 A | * | 4/2019 | |

(Continued)

OTHER PUBLICATIONS

Schwanitz et al.; Pressure variations on a train—Where is the threshold to railway passenger comfort; Applied Ergonomics; 44 (2013) pp. 200-209 (Year: 2013).*

(Continued)

*Primary Examiner* — Michael J Zanelli
(74) *Attorney, Agent, or Firm* — Nixon & Vanderhye

(57) ABSTRACT

The railway vehicle is intended to run on a railway including at least one tunnel, wherein it includes a system for protection against pressure waves, and is configured to hermetically isolate the interior of the railway vehicle from the exterior of the railway vehicle when this protection system is activated. The vehicle includes a geolocation unit providing instantaneous geolocation coordinates of the railway vehicle, wherein a database includes fixed geolocation coordinates of an entry point of this tunnel for each tunnel of the railway, and a unit for comparing the instantaneous coordinates with the fixed coordinates, and wherein it is configured to indicate when the instantaneous geolocation coordinates of the railway vehicle substantially correspond to the fixed coordinates of the entry point of one of the at least one tunnels.

8 Claims, 1 Drawing Sheet

(56) References Cited

FOREIGN PATENT DOCUMENTS

| | | | | |
|---|---|---|---|---|
| CN | 110203219 | A * | 9/2019 | ..... B61C 17/12 |
| DE | 10229588 | A1 * | 1/2004 | ..... B60J 10/244 |
| DE | 10 2008 056907 | | 5/2010 | |
| DE | 10 2014 205742 | | 10/2015 | |
| EP | 1 308 364 | | 5/2003 | |
| EP | 1 394 010 | | 3/2004 | |
| EP | 1 466 802 | | 10/2004 | |
| FR | 2 748 839 | | 11/1997 | |
| WO | WO 2018/134535 | | 7/2018 | |
| WO | WO-2020010787 | A1 * | 1/2020 | ..... B61D 27/0009 |

OTHER PUBLICATIONS

Xiang et al.; Mechanism and capability of ventilation openings for alleviating micro-pressure waves emitted from high-speed railway tunnels; Building and Environment 132 (2018) pp. 245-254 (Year: 2018).*

Sanok et al.; Passenger comfort on high-speed trains: effect of tunnel noise on the subjective assessment of pressure variations; Ergonomics, 58:6,1022-1031, (2015) DOI: 10.1080/00140139.2014.997805 (Year: 2015).*

European Search Report, EP 18 30 6540, dated Apr. 25, 2019.

* cited by examiner

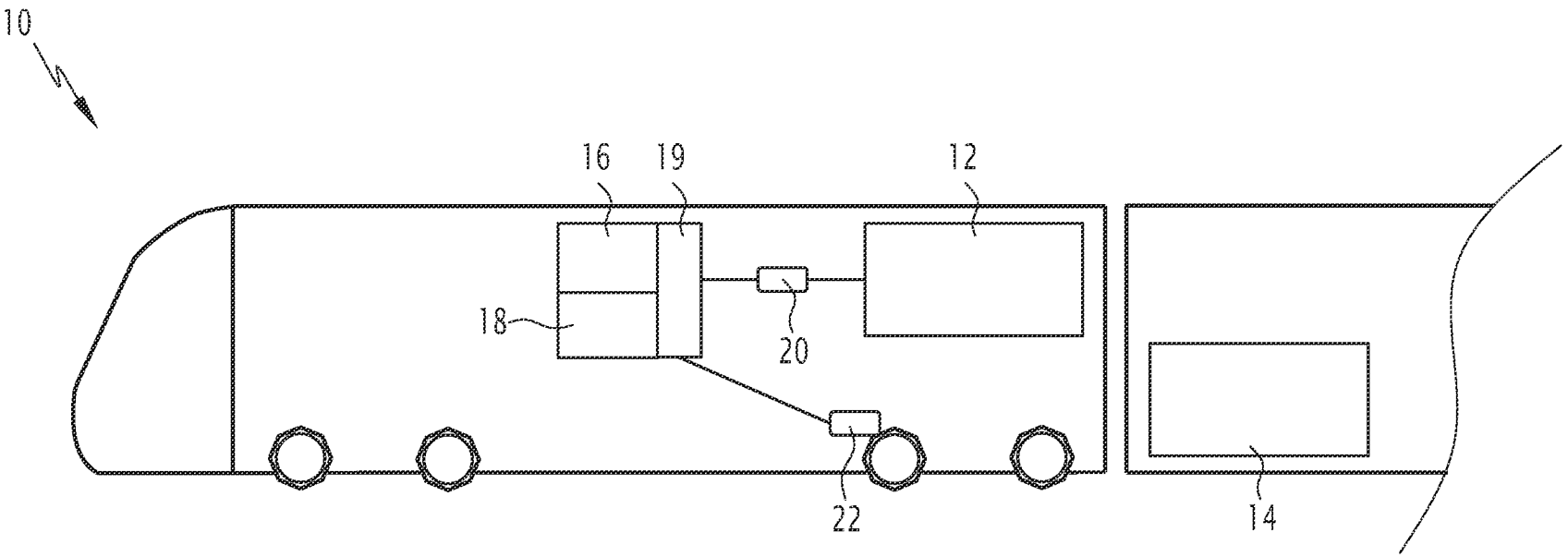
10
16
18
19
20
12
22
14

RAILWAY VEHICLE COMPRISING A PERFECTED SYSTEM OF PROTECTION AGAINST PRESSURE WAVES

BACKGROUND OF THE INVENTION

Field of the Invention

The present invention relates to a particular system equipping a railway vehicle intended to run on a railway comprising at least one tunnel.

Description of the Related Art

When a railway vehicle enters a tunnel, it generates a pressure wave that is a source of discomfort for passengers, in particular in their ears.

In order to remedy this drawback, a prior art pressure-wave protection system configured to hermetically isolate the interior of the railway vehicle from the exterior of this railway vehicle is already known when this protection system is activated.

For this purpose, beacons are generally arranged on the railway track, near the entrances, and generally the exits, of the tunnels.

The railway vehicle then comprises means for detecting these beacons. When such a beacon is detected, i.e. when the railway vehicle approaches a tunnel equipped with this beacon, a signal is transmitted to the driver of the railway vehicle, so that they manually activate the protection system before entry of the railway vehicle into the tunnel.

Such a system is not, however, completely satisfactory.

In particular, it may happen that some tunnels are not equipped with beacons, in particular when the train runs in several countries, as some countries may not have such facilities.

As a result, such a system is not entirely reliable.

BRIEF SUMMARY OF THE INVENTION

The invention aims, in particular, to overcome this disadvantage by providing a railway vehicle with a protection system offering improved reliability.

To this end, the invention particularly relates to a railway vehicle intended to run on a railway comprising at least one tunnel, the railway vehicle comprising a pressure wave protection system configured to hermetically isolate the interior of the railway vehicle from the exterior of this railway vehicle when this protection system is activated, characterized in that it comprises:

- geolocation means providing instantaneous coordinates for geolocation of the railway vehicle,
- a database comprising, for each tunnel of the railway, fixed geolocation coordinates of an entry point of this tunnel,
- means for comparing the instantaneous coordinates with the fixed coordinates, and configured to indicate when the instantaneous geolocation coordinates of the railway vehicle substantially correspond to the fixed coordinates of the entry point of one of the at least one tunnels.

The railway vehicle according to the invention substantially reduces comfort degradations related to pressure waves. As the activation of the protection system is linked to geolocation, there are no longer activation faults linked to the lack of a beacon or the absence of activation by the driver. The system according to the invention is therefore very reliable.

Moreover, the system according to the invention does not depend on the infrastructure of the railway. Thus, the invention can be implemented easily, even when the railway vehicle is traveling in several countries as the geolocation systems are not dependent on countries and their infrastructure. Therefore, the system according to the invention is suitable for all countries without requiring adaptation.

A railway vehicle according to the invention may further comprise one or more of the following features, taken alone or in any technically feasible combination.

- The railway vehicle comprises means for controlling the protection system, configured to automatically activate the protection system when the instantaneous geolocation coordinates of the railway vehicle substantially correspond to the fixed coordinates of the entry point of one of the at least one tunnels;
  - The railway vehicle has an odometer, and: —the database contains information of the length of each of the tunnels of the railway, —the control means are configured to deactivate the protection system when the odometer has determined that the railway vehicle has traveled a distance corresponding to the length information, since the activation of the protection system.
- The railway vehicle comprises an air conditioning system comprising air circulation ducts, while the protection system comprises means for closing at least one air duct.
- The railway vehicle comprises at least one access door from the exterior that is provided at its periphery with at least one seal, the protection system comprising means for inflating each seal.
- The database is so configured that each entry point is arranged upstream of the corresponding tunnel, at a distance that is sufficient to allow sufficient time to effect the hermetic isolation of the vehicle before the actual entry into the tunnel, for example about 5 seconds.

The invention also relates to a method of protection against pressure waves in a railway vehicle as defined above, traveling on a railway track comprising at least one tunnel, characterized in that it comprises:

- the geolocation of the railway vehicle, so as to provide instantaneous geolocation coordinates of the railway vehicle, and
- the comparison of the instantaneous coordinates with the fixed geolocation coordinates of each point of entry.

A protection method according to the invention may further comprise one or more of the following characteristics, taken alone or in any technically feasible combination.

- When the instantaneous geolocation coordinates of the railway vehicle substantially correspond to the fixed coordinates of the entry point of one of the at least one tunnels, the method comprises the control of the activation of the protection system.
- The method comprises the deactivation of the protection system when the odometer has determined that the railway vehicle has traveled a predefined distance corresponding to the length information since the activation of the protection system.

BRIEF DESCRIPTION OF THE DRAWINGS

The invention will be better understood upon reading the following description, given solely by way of example and with reference to the attached figure schematically representing a railway vehicle according to an exemplary embodiment of the invention.

DETAILED DESCRIPTION OF THE PREFERRED EMBODIMENTS

The FIGURE shows, schematically and partially, a railway vehicle 10 according to an exemplary embodiment of the invention.

The railway vehicle 10 is intended to run on a railway comprising at least one tunnel, and generally a plurality of tunnels.

The railway vehicle 10 comprises a system 12 for protecting against pressure waves, and configured to hermetically isolate the interior of the railway vehicle 10 from the exterior of this railway vehicle 10 when this protection system 12 is activated.

The general principle of such a protection system 12 is known per se, so that it will not be described in more detail. Such a protection system 12 is able to implement hermetic isolation measures for any passage between the interior and the exterior of the railway vehicle 10, so that a pressure change outside the railway vehicle 10 does not affect the interior.

For example, the protection system 12 according to the invention comprises means for sealing air ducts opening to the outside. More particularly, the railway vehicle 10 comprises an air conditioning system 14, wherein this air conditioning system 14 conventionally comprises air circulation ducts, some of which open to the outside of the railway vehicle 10. The protection system 12 thus comprises means for closing off at least one air circulation duct of the air conditioning system 14, and preferably all the air circulation ducts opening to the outside. These closure means comprise, for example, one valve per air circulation duct to be sealed, wherein each valve is preferably provided with a seal to allow as tight a sealing as possible.

Advantageously, the railway vehicle 10 comprises access doors from the outside, wherein these access doors are provided with seals for sealing these access doors. According to an advantageous aspect of the invention, the protection system 12 comprises means for inflating each seal. Thus, the hermetic insulation of the railway vehicle 10 is further improved.

Preferably, the railway vehicle 10 comprises only sealed windows that are devoid of opening means. In the opposite case, means will be provided for automatically closing the windows under the control of the protection system when it is activated.

The railway vehicle 10 according to the invention also comprises geolocation means 16 providing instantaneous geolocation coordinates of the railway vehicle. Such geolocation means are conventional, and will not be described in detail. For example, the invention uses the same geolocation means as those usually present on railway vehicles of the prior art.

For example, the geolocation means 16 are in the form of a conventional satellite geo-positioning system (GPS).

The railway vehicle 10 according to the invention further comprises a database 18 comprising fixed geolocation coordinates of the entry point for each tunnel of the railway, Each entry point is previously chosen during the configuration of the database 18, on the railway near a corresponding tunnel. Preferably, each entry point is chosen upstream of the tunnel, at a distance that is sufficient to allow sufficient time to effect the hermetic isolation of the vehicle 10 before actual entry into the tunnel. This time is, for example, about 5 seconds.

Said sufficient distance is easily calculated by knowing the expected speed of the railway vehicle 10 at the entry point of the corresponding tunnel. The speed taken into account in this calculation may be, for example, equal to the speed limit provided on the railway at the entry point of the tunnel.

Advantageously, the database 18 also comprises, for each tunnel, length information, in particular corresponding to the length of the tunnel, preferably added to said sufficient distance.

The railway vehicle 10 further comprises means 19 for comparing the instantaneous coordinates with the fixed coordinates. Thus, the comparison means 19 compare in real time the position of the railway vehicle 10 relative to the tunnels and, more precisely, to the entry points.

The comparison means 19 are designed to indicate when the instantaneous geolocation coordinates of the railway vehicle 10 substantially correspond to the fixed coordinates of the entry point of one of the at least one tunnels. In other words, the comparison means 19 indicate when the railway vehicle 10 arrives at an entry point.

In an advantageous embodiment, the railway vehicle 10 further comprises means 20 for controlling the protection system 12, and that are configured to automatically activate the protection system 12 when the instantaneous geolocation coordinates of the railway vehicle 10 substantially correspond to the fixed coordinates of the entry point of one of the at least one tunnels.

It should be noted that, in the prior art, the activation of the protection system was manual as performed by the driver when a tunnel entry beacon was detected. Such manual activation is not entirely reliable, as the driver may not in some cases activate it due to forgetfulness f or for any other reason preventing them from performing this activation.

Thus, the reliability of the system is improved thanks to the automatic control means 20.

However, alternatively, the railway vehicle 10 could include a manual activation system as in the prior art.

Advantageously, the railway vehicle 10 includes an odometer 22. Such an odometer 22 is conventional and will not be described in more detail. More particularly, prior art railway vehicles are usually already equipped with such an odometer that is able to calculate the mileage traveled, in particular by acquisition and processing of the signals of its sensors on the axles.

The control means 20 are then configured to deactivate the protection system 12 when the odometer 22 has determined that the railway vehicle has traveled a predefined distance based on said tunnel length information since the activation of the protection system 12.

As indicated above, this length information is based on the length of the corresponding tunnel, and corresponds, for example, to the sum of this length of the tunnel, i.e. said sufficient distance defined between the entry point and the tunnel, and preferably of an additional distance.

This additional distance makes it possible to ensure that the railway vehicle is well out of the tunnel before deactivating the protection system 12.

For example, the additional distance may leave a time of about one to two seconds after the exit of the tunnel before deactivating the protection system 12.

Said additional distance is easily calculated by knowing the expected speed of the railway vehicle 10 at the exit of the corresponding tunnel. The speed taken into account in this calculation is, for example, equal to the speed limit provided on the railway at the exit of the tunnel.

This embodiment is advantageous in that the geolocation system 16 is not active in the tunnels, so that it is more reliable to rely on the odometer 22 for the deactivation of the protection system 12.

However, alternatively, deactivation of the protection system 12 may be provided when the comparison means 20 indicate when the instantaneous geolocation coordinates of the railway vehicle 10 substantially correspond to the fixed coordinates of an exit point of the tunnel. In this case, the database 18 also has fixed coordinates of such exit points.

This variant may be preferred when using a powerful geolocation system that is active even in tunnels.

The invention makes it possible to carry out a method of protection against pressure waves, which will now be described.

This method comprises:

the geolocation of the railway vehicle 10, to provide instantaneous geolocation coordinates of the railway vehicle 10, and the comparison of the instantaneous coordinates with the fixed geolocation coordinates of each tunnel entry point of the railway.

In the embodiment described, the method comprises, when the instantaneous geolocation coordinates of the railway vehicle substantially correspond to the fixed coordinates of the entry point of one of the at least one tunnels, the control of the activation of the protection system. 12.

Advantageously, the method comprises the deactivation of the protection system 12 when the odometer 22 has determined that the railway vehicle has traveled a predefined distance corresponding to the length information since the activation of the protection system.

It should be noted that the invention is not limited to the embodiment described above, but could have alternative variants.

The invention claimed is:

1. A railway vehicle for traveling on a railway including at least one tunnel, the railway vehicle having an interior and having a pressure wave protection system configured to hermetically isolate the interior of the railway vehicle from an exterior of the railway vehicle when the pressure wave protection system is activated, the railway vehicle comprising:

a geolocation system providing instantaneous geolocation coordinates of the railway vehicle;

a database comprising fixed geolocation coordinates of an entry point of the tunnel for each tunnel of the railway;

a comparator configured to compare the instantaneous geolocation coordinates with the fixed geolocation coordinates and configured to indicate when the instantaneous geolocation coordinates of the railway vehicle correspond to the fixed geolocation coordinates of the entry point of one of the at least one tunnel;

at least one access door configured to be accessed from the exterior, said at least one access door being provided at a periphery thereof with at least one inflatable seal wherein the pressure wave protection system comprising means for inflating including an inflation device configured to inflate each of the at least one inflatable seal when the comparator indicates that the instantaneous geolocation coordinates of the railway vehicle correspond to the fixed geolocation coordinates of the entry point of one of the at least one tunnel.

2. The railway vehicle according to claim 1, further comprising a controller configured to control the pressure wave protection system to automatically activate the pressure wave protection system when the instantaneous geolocation coordinates of the railway vehicle correspond to the fixed geolocation coordinates at the point of entry of one of the at least one tunnel.

3. The railway vehicle according to claim 2, further comprising an odometer, wherein:

the database comprises length information associated with each of the at least one tunnel of the railway, and the controller is configured to deactivate the pressure wave protection system when the odometer determines that the railway vehicle has traveled a corresponding distance to the length information, since the activation of the pressure wave protection system.

4. The railway vehicle according to claim 1, further comprising an air conditioning system comprising air circulation ducts, wherein the pressure wave protection system comprises a closure device configured to close at least one of the air circulation ducts.

5. The railway vehicle according to claim 1, wherein the database is configured so that each of the entry points is disposed upstream of the corresponding tunnel, at a sufficient distance that leaves sufficient time to hermetically isolate the railway vehicle before actual entry into the tunnel.

6. A protection method of protection against pressure waves in a railway vehicle traveling on a railway including at least one tunnel, the railway vehicle having an interior and having a pressure wave protection system configured to hermetically isolate the interior of the railway vehicle from an exterior of this the railway vehicle when the pressure wave protection system is activated, the railway vehicle including a geolocation system providing instantaneous geolocation coordinates of the railway vehicle, a database comprising fixed geolocation coordinates of an entry point of the at least one tunnel for each of the tunnels of the railway, a comparator paring configured to compare the instantaneous geolocation coordinates with the fixed geolocation coordinates to indicate when the instantaneous geolocation coordinates of the railway vehicle correspond to the fixed geolocation coordinates of the entry point of one of the at least one tunnel, and at least one access door configured to be accessed from the exterior, said at least one access door being provided at a periphery thereof with at least one inflatable seal, the pressure wave protection system including an inflation device configured to inflate each of the at least one inflatable seal, the protection method comprising:

providing the railway vehicle;

geolocating the railway vehicle to provide instantaneous geolocation coordinates of the railway vehicle;

comparing the instantaneous coordinates with the fixed geolocation coordinates of each of the entry points; and inflating each of the at least one inflatable seal, when the comparator indicates that the instantaneous geolocation coordinates of the railway vehicle correspond to the fixed geolocation coordinates of the entry point of one of the at least one tunnel.

7. The protection method according to claim 6, further comprising controlling, by a controller in the railway vehicle, the pressure wave protection system to automatically activate the pressure wave protection system when the instantaneous geolocation coordinates of the railway vehicle correspond to the fixed geolocation coordinates at the point of entry of one of the at least one tunnel; and controlling activation of the pressure wave protection system when the instantaneous geolocation coordinates of the railway vehicle correspond to the fixed coordinates of the point of entry of one of the at least one tunnel.

8. The protection method according to claim 7, wherein the railway vehicle includes an odometer, wherein the database comprises length information associated with each of the at least one tunnel of the railway, and the protection method further comprises deactivating the pressure wave protection system when the odometer determines that the railway vehicle has traveled a predefined distance corresponding to the length information since the activation of the pressure wave protection system.

* * * * *